US008516745B2

(12) United States Patent
Fujisaki et al.

(10) Patent No.: US 8,516,745 B2
(45) Date of Patent: Aug. 27, 2013

(54) REGULATOR DEVICE FOR VEHICLE DOOR WINDOW PANE

(75) Inventors: Tomoyuki Fujisaki, Toyohashi (JP); Masashi Yonemoto, Toyokawa (JP); Masako Yamazaki, Gamagori (JP)

(73) Assignee: Shiroki Corporation, Kanagawa (JP)

( * ) Notice: Subject to any disclaimer, the term of this patent is extended or adjusted under 35 U.S.C. 154(b) by 0 days.

(21) Appl. No.: 13/413,943

(22) Filed: Mar. 7, 2012

(65) Prior Publication Data

US 2012/0159854 A1 Jun. 28, 2012

Related U.S. Application Data

(63) Continuation of application No. PCT/JP2010/062872, filed on Jul. 30, 2010.

(30) Foreign Application Priority Data

Sep. 8, 2009 (JP) ..... 2009-207310

(51) Int. Cl.
*E05F 11/44* (2006.01)

(52) U.S. Cl.
USPC ..... 49/351

(58) Field of Classification Search
USPC ..... 49/348, 349, 351, 352, 350
See application file for complete search history.

(56) References Cited

U.S. PATENT DOCUMENTS

| | | | | |
|---|---|---|---|---|
| 3,231,301 | A * | 1/1966 | Gray | 403/164 |
| 3,897,652 | A * | 8/1975 | Hess | 49/351 |
| 4,986,029 | A * | 1/1991 | Richter | 49/349 |
| 5,595,025 | A * | 1/1997 | MacPhail-Fausey | 49/351 |
| 6,003,268 | A * | 12/1999 | Oruganty | 49/351 |
| 6,279,269 | B1 * | 8/2001 | Isomura et al. | 49/351 |
| 6,912,811 | B2 * | 7/2005 | Kawashima et al. | 49/351 |

FOREIGN PATENT DOCUMENTS

| | | |
|---|---|---|
| JP | 2-81893 U | 6/1990 |
| JP | 11-210319 A | 8/1999 |
| JP | 2000-192727 A | 7/2000 |
| JP | 2003-13663 A | 1/2003 |

OTHER PUBLICATIONS

International Search Report of PCT/JP2010/062872 (Sep. 1, 2010).

* cited by examiner

*Primary Examiner* — Jerry Redman
(74) *Attorney, Agent, or Firm* — Millen, White, Zelano & Branigan, P.C.

(57) ABSTRACT

A regulator device for a vehicle door window pane includes a lift arm connected to a door window pane and an equalizer arm rotatably connected to the lift arm, connected to the door and the door window pane. The lift arm includes a through-hole, a flange wall, and a protrusion that defines an annular clearance between the protrusion and the flange wall and protrudes by a greater amount. The equalizer arm includes a first arm in contact with the protrusion, and a second arm in contact with the other side of the lift arm. A rotational axial protrusion rotatably engaged in the through-hole is formed on one of the first and second arms, and a fixing portion fixed to the rotational axial protrusion outside the through-hole is formed on the other of the first and second arms.

6 Claims, 5 Drawing Sheets

REGULATOR DEVICE FOR VEHICLE DOOR WINDOW PANE

RELATED APPLICATION DATA

This is a continuation of International Application No. PCT/JP2010/062872, with an international filing date of Jul. 30, 2010, which is herein incorporated by reference in its entirety.

TECHNICAL FIELD

The present invention relates to an X-link mechanism type of regulator device, contained in a vehicle door, for raising and lowering a door window pane.

BACKGROUND OF THE INVENTION

A conventional regulator device, installed in an internal space of a vehicle door, for raising and lowering a door window pane is disclosed in, e.g., Patent Document 1. The regulator device disclosed in Patent Document 1 is of an X-link type which is equipped with a lift arm and an equalizer arm.

The lift arm is formed from a metal plate, and an elongated reinforcing protrusion (rib) which protrudes toward one side of the lift arm is formed at a central portion of the lift arm, in the widthwise direction thereof, by press-forming. In addition, a circular through-hole is formed through a central portion of the elongated reinforcing protrusion in the lengthwise direction thereof, and a ring-shaped flange wall which protrudes in the same protruding direction as the elongated reinforcing protrusion is formed on the circumferential edge of the through hole. The lift arm is connected at one end thereof to the lower end of a door window pane to be slidable in the forward/rearward direction and rotatable about a rotation axis extending in the widthwise direction of the door, and the lift arm is provided at the other end thereof with a driven gear which receives a driving force from a drive source (e.g., a motor) installed in the door.

On the other hand, the equalizer arm is also formed from a metal plate and configured of two arm members which are joined to each other. The lower end of the lower arm, which is one of the two arms of the equalizer arm, is connected to an inner surface of the door to be slidable in the forward/rearward direction and rotatable about an axis parallel to the aforementioned rotational axis. On the other hand, the upper arm, which is the other arm member of the equalizer arm, is positioned on the opposite side of the lift arm from the lower arm, and the upper end of the upper arm is connected to the lower end of the door window pane to be slidable in the forward/rearward direction and rotatable about an axis parallel to the aforementioned rotational axis. In addition, a pivot which projects from the upper end of the lower arm is rotatably fitted into a through-hole of the lift arm, and the lower end of the upper arm is fixed to an end face of the pivot, and accordingly, the equalizer arm, which is composed of the upper arm and the lower arm, and the lift arm are mutually connected at their intermediate portions to be rotatable relative to each other.

Transmission of the driving force of the aforementioned drive source to the drive gear causes the lift arm to rotate, which causes one end of the lift arm to slide while rotating relative to the door window pane, and accordingly, the door window pane moves up or down together with the one end of the lift arm to shut or open the window opening formed in an upper half of the vehicle door. In addition, since the equalizer arm rotates about the intermediate portion (pivot) thereof while sliding relative to both the door window pane and the door following the ascending/descending operation of the door window pane, the upper and lower positions of the upper end of the equalizer arm are the same as those of the one end of the lift arm at all times. Therefore, the door window pane slides in the vertical direction relative to the door without tilting.

Moreover, the lower arm includes an annular projection which is positioned on the outer peripheral side of the pivot and which projects in the same direction as the pivot, and the end face of the aforementioned annular projection is rotatably in contact with a side of the lift arm. Therefore, as shown in FIG. 3 in Patent Document 1, an end surface of the flange wall of the lift arm and a side (counter-face surface) of the lower arm are in noncontact with each other (clearance is formed therebetween) at all times, and accordingly, no needless sliding resistance occurs between the lift arm and the lower arm. Accordingly, the lift arm and the equalizer arm rotate smoothly, so that the ascending/descending operation of the door window pane is carried out smoothly.

CITATION LIST

Patent Document 1: Japanese Patent Publication No. 3,402,231

SUMMARY OF INVENTION

Technical Problem

Since the flange wall of the lift arm protrudes further from the elongated reinforcing protrusion (through-hole) in the same protruding direction as the elongated reinforcing protrusion, the thickness of the entire lift arm that includes the elongated protrusion and the flange wall is quite thick. As a result, not only the lift arm but also the entire regulator device becomes thick (in the widthwise direction of the door).

In addition, it is possible to mold the annular projection and the pivot of the lower arm by a drawing process; however, it is not easy to continuously form, on a single member by a drawing process, two projections (a pivot and an annular projection) which are located near each other and project by a large amount, so that there is a possibility of the lower arm being formed into an unintentional shape (e.g., formed to have holes or cracks) if, e.g., the manner of applying a force to the lower arm during the drawing process is even slightly incorrect.

An object of the present invention is to provides a regulator device for a vehicle door window pane which makes it possible to reduce the thickness of the lift arm and the entire device and further makes it possible to mold the equalizer easily using a drawing process.

Solution to Problem

The regulator device according to the prevent invention is characterized by a regulator device for a vehicle door window pane, including a lift arm which is installed in an internal space of a vehicle door and connected at one end of the lift arm to a door window pane which is movable relative to the door, wherein the other end of the lift arm receives a rotational force from a drive source; and an equalizer arm which is installed in the internal space, rotatably connected to an intermediate portion of the lift arm, and wherein one end of the equalizer arm is connected to the door and the other end of the equalizer is connected to the door window pane. The lift arm includes a through-hole formed through the intermediate portion; a flange wall having a ring shape which is formed at a circumferential edge of the through-hole to project from one side of the lift arm; and a protrusion formed to define an annular clearance between the protrusion and the flange wall and to protrude in the same protruding direction as the flange wall by a greater amount than the flange wall. The equalizer arm includes a first arm which is positioned on one side of the lift arm and includes a rotational contact surface which is rotatably in contact with the protrusion; and a second arm which is positioned on the other side of the lift arm and rotatably in contact with the other side of the lift arm, and wherein a rotational axial protrusion which is rotatably engaged in the through-hole, so as to pass through the through-hole, is formed on one of the first arm and the second arm, and a fixing portion which is fixed to the rotational axial protrusion outside the through-hole is formed on the other of the first arm and the second arm.

The rotational axial protrusion can be formed on the first arm and the fixing portion can be formed on the second arm.

The protrusion can be a part of an elongated protrusion which is elongated in the lengthwise direction of the lift arm.

Advantageous Effects of Invention

In the regulator device according to the present invention, the equalizer arm, which is configured of the first and the second arm, and the lift arm rotate smoothly relative to each other since the rotational contact surface of the first arm is rotatably in contact with a protrusion of the lift arm without being in contact with the flange wall of the lift arm and since the second arm is rotatably in contact with the lift arm.

In addition, since the flange wall of the lift arm is projected at a different position from the protrusion, the entire lift arm that includes the protrusion is thinner than the conventional thickness. Accordingly, it is possible to reduce not only the thickness of the lift arm but also the thickness of the entire regulator device (in the widthwise direction).

Additionally, in the case where the rotational axial protrusion is formed on the first arm, the rotational axial protrusion can be formed easily using a drawing process since any other protrusion does not exit around the rotational axial protrusion of the first arm.

Additionally, if an elongated protrusion, which extends in the lengthwise direction of the lift arm and is spaced apart toward a central line of the lift arm from both edges of the lift arm, is formed on the lift arm, the rigidity of the lift arm can be enhanced. Moreover, if the aforementioned elongated protrusion (a portion thereof) is used as a protrusion for keeping the flange wall of the lift arm and the rotational contact surface of the first arm in noncontact with each other, the shape of the lift arm can be simplified as compared with the case where the protrusion is formed separately from the elongated protrusion.

DESCRIPTION OF EMBODIMENTS

Figure 1:
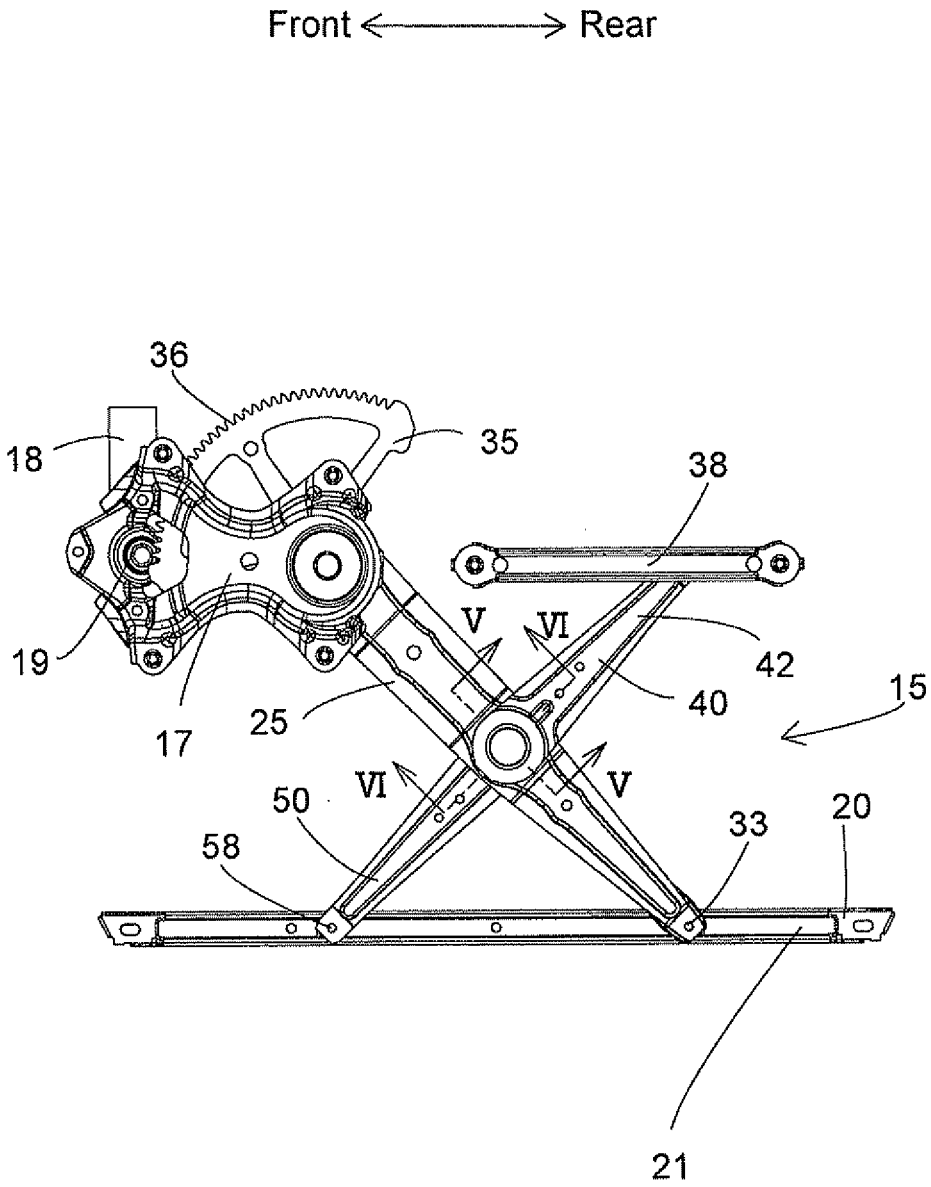
FIG. 1 is a side elevational view of an embodiment of a regulator device according to the present invention.
Figure 2:
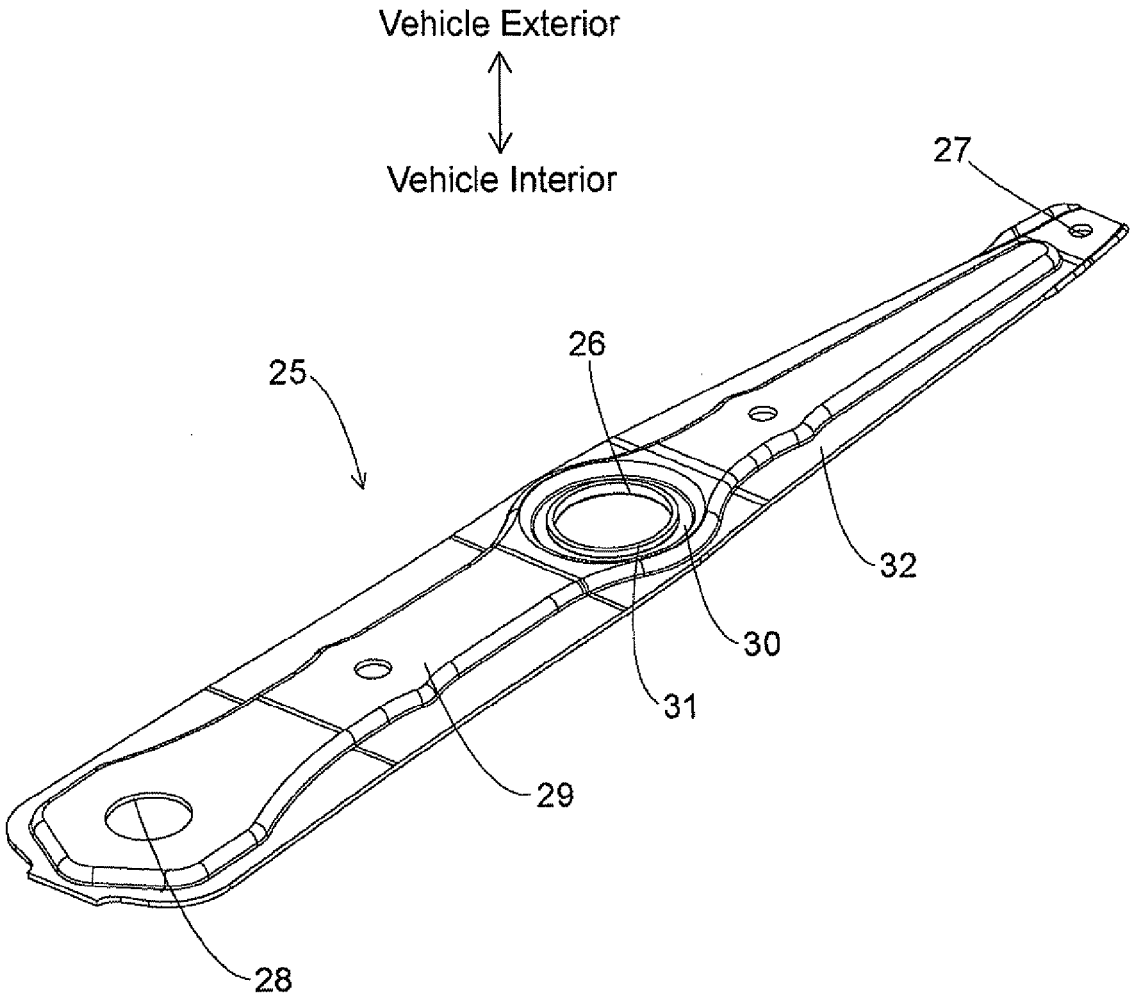
FIG. 2 is a perspective view of a lift arm.
Figure 3:
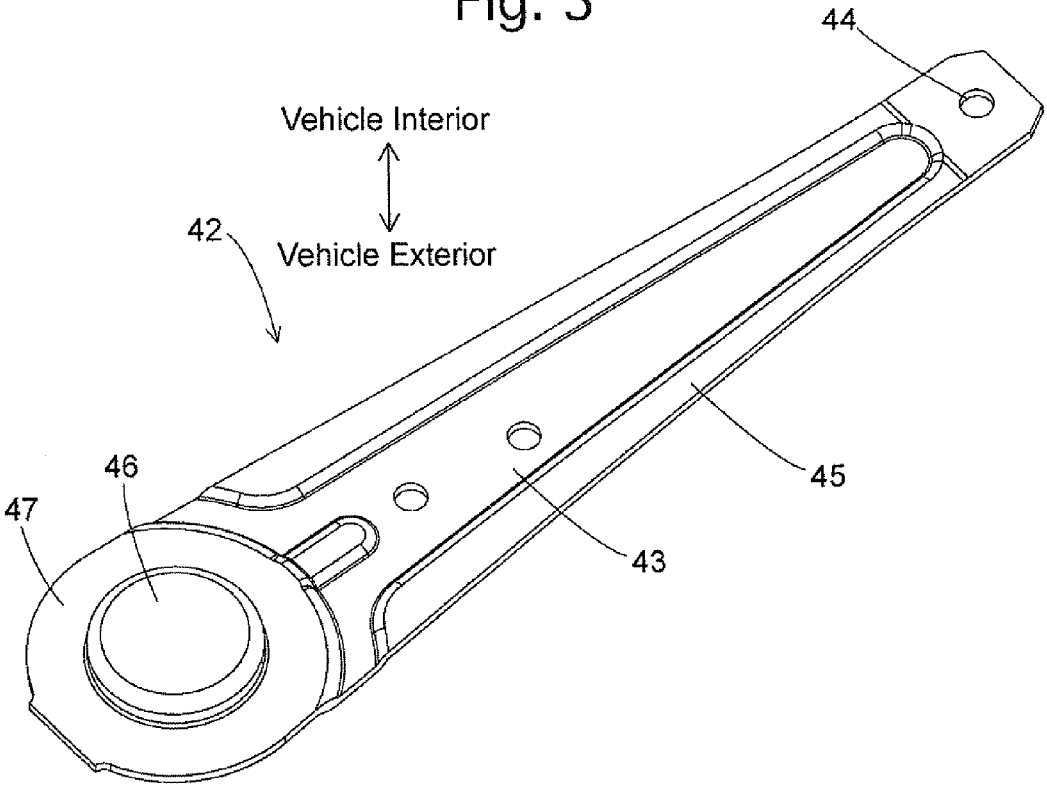
FIG. 3 is a perspective view of the first arm of an equalizer.
Figure 4:
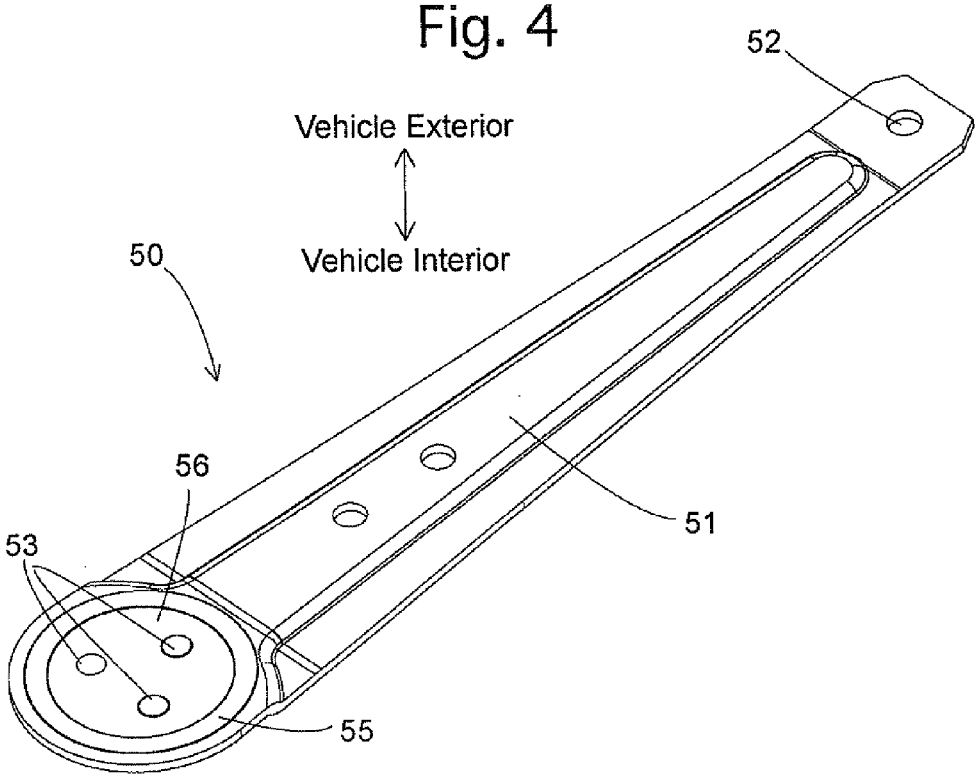
FIG. 4 is a perspective view of the second arm of the equalizer.

An embodiment of the present invention will be hereinafter discussed with reference to the accompanying drawings.

The present embodiment of the regulator device 15 is contained in a door (not shown) for opening and closing a side opening of a vehicle body. A window opening is formed in an upper half of the door and an internal space which is communicatively connected to the window opening is formed in a lower half of the door. The door is provided with a door window pane, the lower end of which is positioned in the aforementioned internal space at all times and which is slidable in the vertical direction between a fully-closed position (upper limit position) to fully close the window opening and a fully-open position (lower limit position) to fully open the window opening.

The door is further provided in the aforementioned internal space of the door with a regulator device 15 having the structure which will be described hereinafter. The regulator device 15 is a so-called X-link type of regulator and is provided, as main components thereof, with a motor 18, a lift arm bracket 20, a lift arm 25, an equalizer bracket 38 and an equalizer arm 40 (a first arm 42 and a second arm 50).

A base member 17 which supports the motor 18 is fixed to a wall surface in the internal space of the door on the vehicle interior side, the lift arm bracket 20 is fixed to the lower end of a surface of the door window pane on the vehicle interior side, and the lift arm 25 is installed between the base member 17 (the motor 18) and the lift arm bracket 20.

The lift arm 25 is a long plate member which is formed by a press-forming process and a burring process on a metal plate. The lift arm 25 is provided with a circular through-hole 26, a pin support hole 27, a gear fixing hole 28 and an elongated reinforcing protrusion 29 by a press-forming process. The elongated reinforcing protrusion 29 (the surface of the elongated reinforcing protrusion 29 on the vehicle interior side is recessed) that protrudes toward the vehicle exterior side is formed on a portion of the lift arm 25 which is inwardly from the outer edge of the lift arm 25 and elongated in the lengthwise direction of the lift arm 25. Upon the press-forming being performed, an annular clearance 30 having an annular (circular) shape which surrounds the through-hole 26 remains between the through-hole 26 and the elongated reinforcing protrusion 29 (the annular clearance 30 lies in a plane in which a peripheral portion 32 around the elongated reinforcing protrusion 29 lies).

Figure 5:
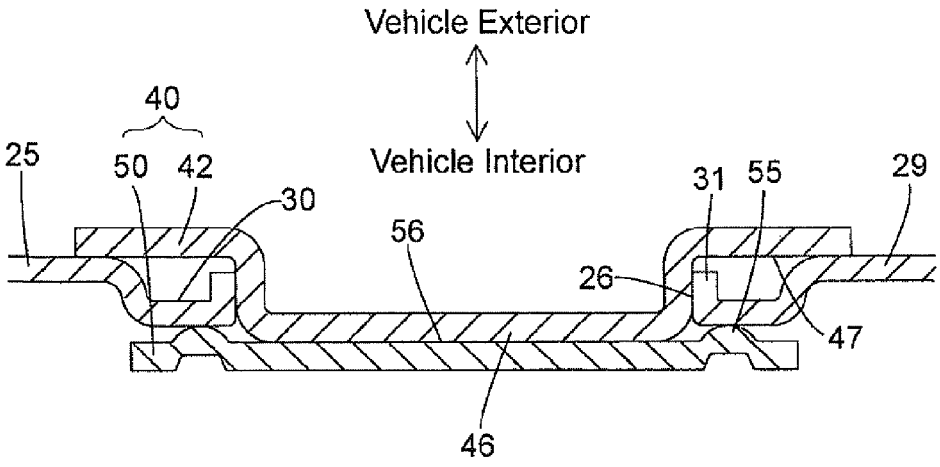
FIG. 5 is a cross sectional view taken along the line V-V shown in FIG. 1.
Figure 6:
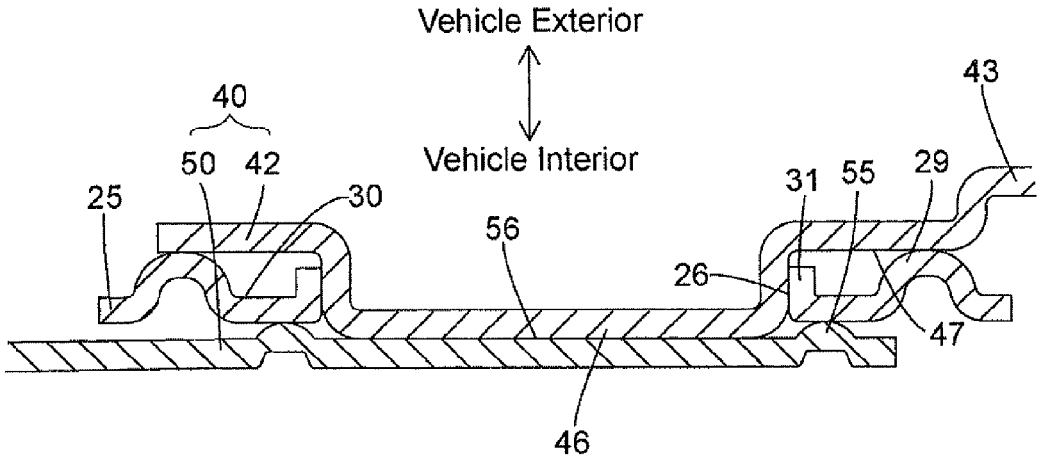
FIG. 6 is a cross sectional view taken along the line VI-VI shown in FIG. 1.

In addition, due to a burring process being carried out on the circumferential edge of the through-hole 26 after the press-forming process, a ring-shaped (circular) flange wall 31 which protrudes in the same protruding direction as the elongated reinforcing protrusion 29 is formed on the circumferential edge of the through hole 26. As shown in FIGS. 5 and 6, the elongated reinforcing protrusion 29 is greater in the amount of protrusion toward the vehicle exterior side than the flange wall 31.

The end of the lift arm 25 on the fixed hole 28 side is rotatably supported by the base member 17 via a rotational support shaft which extends in the widthwise direction of the door (the direction of the wall thickness of the lift arm 25). A rotational slide pin 33 in the shape of a cylindrical column which extends in the widthwise direction of the door is engaged in the pin support hole 27, and the rotational slide pin 33 is engaged in a slide groove 21 of the lift arm bracket 20 to be slidable in the forward/rearward direction and rotatable on the axis of the rotational slide pin 33. On the other hand, a metal driven gear 35 having the shape of a sector is fixed by welding to an end of the lift arm 25 using the gear fixed hole 28, and a gear portion 36 formed on a peripheral surface of the driven gear 35 is linked (engaged) with a pinion gear 19 fixed to the output shaft of the motor 18.

The equalizer bracket 38 that extends in the forward/rearward direction is fixed to a wall surface on the vehicle interior side in the internal space of the door. The equalizer arm 40 that constitutes, together with the lift arm 25, the X-link mechanism is installed between the equalizer arm bracket 38 and the lift arm bracket 20. The equalizer 40 is configured of two members: the first arm 42 and the second arm 50.

The first arm 42 is a long plate member which is formed by carrying out a press-forming process and a drawing process on a metal plate. The first arm 42 is provided with an elongated reinforcing protrusion 43 and a pin support hole 44 by a press-forming process. The elongated reinforcing protrusion 43 that projects toward the vehicle exterior side (the surface of the elongated reinforcing protrusion 43 is recessed on the vehicle interior side) is formed on a portion of the first arm 42 which is spaced apart inwardly from the outer edge of the first arm 42 and elongated in the lengthwise direction of the first arm 42. In addition, by a drawing process performed after the press-forming process, a rotational axial protrusion 46 which is circular in side view and substantially identical in diameter to the through-hole 26 is formed on the second arm 42 at the opposite end thereof from the pin support hole 44 to protrude toward the vehicle interior side (the surface of the rotational axial protrusion 46 on the vehicle exterior side is recessed). In addition, upon completion of the press-forming process and the drawing process, a ring-shaped rotational contact surface 47 having an annular (circular) shape remains around the rotational axial protrusion 46 without being worked on (the rotational contact surface 47 lies in a plane in which a peripheral portion 45 around the elongated reinforcing protrusion 43 lies).

The first arm 42 is positioned on one side of the lift arm 25 on the vehicle exterior side, the rotational axial protrusion 46 is engaged in the through-hole 26 of the lift arm 25 from the vehicle exterior side to be rotatable relative to the through-hole 26, and the rotational contact surface 47 is in contact with the elongated reinforcing protrusion 29 of the lift arm 25 (a portion thereof positioned around the annular clearance 30) (see FIGS. 5 and 6). On the other hand, a rotational slide pin (not shown) identical in shape to the rotational slide pin 33 is engaged in the pin support hole 44 of the first arm 42, and the above-mentioned rotational slide pin is engaged in a slide groove formed in a surface of the equalizer arm bracket 38 on the vehicle interior side to be slidable in the forward/rearward direction and rotatable on the axis of the aforementioned rotational slide pin.

The second arm 50 is a long plate member which is formed by a press-forming process and a drawing process on a metal plate. The second arm 50 is provided with an elongated reinforcing protrusion 51, a pin support hole 52 and three welding projections 53 by a press-forming process. The elongated reinforcing protrusion 51 that projects toward the vehicle exterior side (the surface of the elongated reinforcing protrusion 51 is recessed on the vehicle interior side) is provided with a substantially circular portion formed at the opposite end of the second arm 50 from the pin support hole 52, and an elongated portion formed on a portion of the second arm 50 which extends toward the pin support hole 52 from the aforementioned circular portion and is spaced apart inwardly from the outer edge of the second arm 50. In addition, due to a drawing process being performed after the press-forming process, a ring-shaped (circular) contact projection 55 which is greater in diameter than the rotational axial protrusion and smaller in projecting amount than the elongated reinforcing protrusion 29 is formed around the welding projections 53 to project toward the vehicle exterior side. A portion positioned radially inside the contact projection 55 (a portion on which the welding projections 53 is formed) is formed as a fixing surface (fixing portion) 56 which lies in a plane in which the aforementioned elongated portion of the elongated reinforcing protrusion 51 lies.

The second arm 50 is positioned on the vehicle interior side and made integral with the first arm 42 by welding (fixing) the rotational axial protrusion 46 and the fixing surface 56 to each other using the three welding projections 53 with the fixing surface 56 made in contact with a surface of the rotational axial protrusion 46 on the vehicle interior side, thereby constituting, together with the first arm 42, the equalizer arm 40. As shown in FIGS. 5 and 6, the contact projection 55 is rotatably in contact with a surface of the lift arm 25 on the vehicle interior side (the back of the annular clearance 30), and the equalizer arm 40 is rotatable about the rotational axial protrusion 46 relative to the left arm 25.

On the other hand, a rotational slide pin 58 which is identical in shape to the rotational slide pin 33 is engaged in the pin support hole 52 of the second arm 50, and the rotational slide pin 58 is engaged in the slide groove 21 of the lift arm bracket 20 to be slidable in the forward/rearward direction and rotatable on the axis of the rotational slide pin 58.

The regulator device 15 that has the above structure operates in a manner which will be discussed hereinafter.

Forward rotation of the motor 18 that is caused by an operation of a window pane up/down switch (not shown) in the closing direction which is provided on a surface of the door on the vehicle interior side causes the lift arm 25 to receive a rotational force from the pinion gear 19 of the motor 18 via the driven gear 35 (the gear portion 36) and rotate about the aforementioned rotational support shaft in the counterclockwise direction with respect to FIG. 1. Thereupon, the rotational slide pin 33 slides rearward in the slide groove 21 while rotating, so that the position of the rotational axial protrusion 46 rises. This causes the equalizer arm 40 to rotate clockwise with respect to FIG. 1 about the rotational axial protrusion 46, causes the lower rotational slide pin 58 to slide forward relative to the slide groove 21 while rotating and causes the upper rotational slide pin to slide rearward in the slide groove of the equalizer arm bracket 38 while rotating. Thereupon, the door window pane 12 rises because the position of the lift arm bracket 20 rises higher than that before the operation of the window pane up/down switch. On the other hand, an operation of the window pane up/down switch (not shown) in the opening direction causes the motor 18 to rotate in reverse, so that the lift arm 25 and the equalizer arm 40 operate in the reverse manner to the above. Accordingly, the door window pane 12 moves down because the position of the lift arm bracket 20 descends lower than that before the operation of the window pane up/down switch.

Moreover, as clearly seen from FIGS. 5 and 6, the contact of the rotational contact surface 47 of the first arm 42 with the elongated reinforcing protrusion 29 of the lift arm 25 keeps the rotational contact surface 47 of the first arm 42 and the flange wall 31 of the lift arm 25 in noncontact with each other, and accordingly, no needless sliding resistance occurs between the first arm 42 (the equalizer arm 40) and the lift arm 25 during the rotational operation of the lift arm 25 and the equalizer arm 40. Hence, the lift arm 25 and the equalizer 40 relatively rotate smoothly, and the door windowpane 12 moves up and down smoothly.

Additionally, in the present embodiment of the regulator device 15, since the flange wall 31 of the lift arm 25 is formed to protrude at a position spaced apart from the elongated reinforcing protrusion 29 (a position where the elongated reinforcing protrusion 29 is not formed), the lift arm 25 that includes the elongated reinforcing protrusion 29 is smaller in thickness than conventional lift arms, and the entire regulator device 15 is also smaller in thickness (in the widthwise direction of the door) than conventional ones.

Additionally, since no other protrusions exist around (in the vicinity of) the rotational axial protrusion 46 of the first arm 42, it possible to form the rotational axial protrusion 46 easily by a drawing process. Accordingly, the moldability of the first arm 42 is favorable.

Additionally, since a portion (a portion positioned around the annular clearance 30) of the elongated reinforcing protrusion 29 that is formed on the lift arm 25 is used as a protrusion for keeping the rotational contact surface 47 and the flange wall 31 in noncontact with each other, the lift arm 25 is simple in shape as compared with the case where the aforementioned protrusion is formed separately from the elongated reinforcing protrusion 29.

Although the rotational axial protrusion 46 is projected from the first arm 42 that constitutes the upper part of the equalizer 40 in the above described present embodiment, the rotational axial protrusion 46 can be projected from the second arm 50 while the fixing surface 56 can be formed on the first arm 42. Furthermore, the first arm 42 can be located in the vehicle inner side with respect to the lift arm 25 while the second arm 50 can be located in the vehicle exterior side with respect to the lift arm 25. In addition the first arm 42 can constitute a lower part of the equalizer arm 40, and the second arm 50 can constitute an upper part of the equalizer arm 40.

Additionally, the elongated reinforcing protrusion 29 can be formed on the lift arm 25 so as to partly surround the periphery of the flange wall 31.

Figure 7:
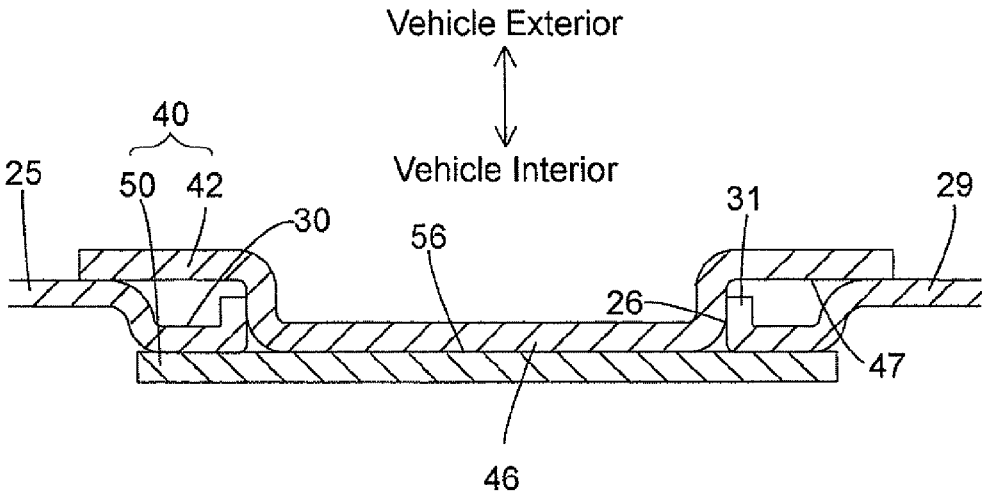
FIG. 7 is a cross sectional view, similar to that of FIG. 5, of a modified embodiment.

As shown in FIG. 7, a surface of the second arm 50 on the vehicle exterior side can be made to rotatably come in contact with a surface of the lift arm 25 on the vehicle interior side (the back of the annular clearance 30) upon omitting the contact projection 55 from the second arm 50.

Figure 8:
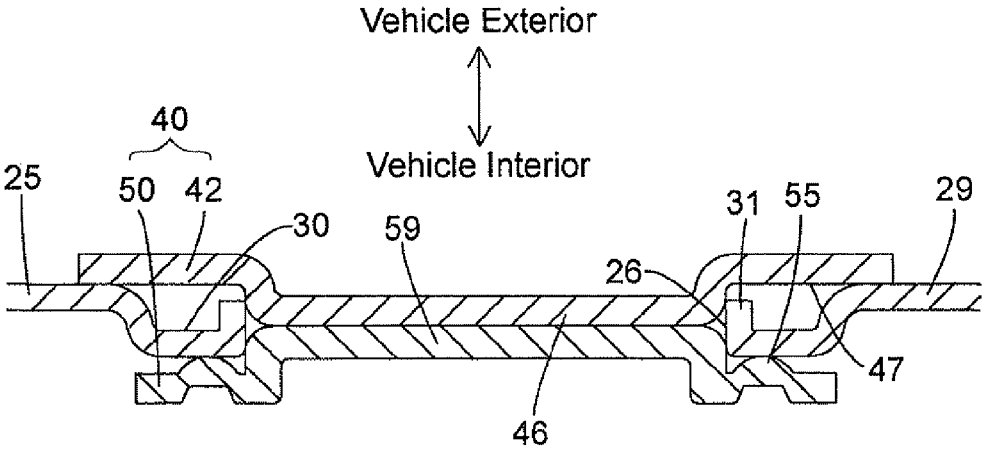
FIG. 8 is a cross sectional view, similar to that of FIG. 5, of another modified embodiment.

In addition, as shown in FIG. 8, a fixing pivot 59 similar to the rotational axial protrusion 46 can be formed on the second arm 50 to protrude therefrom. This fixing pivot 59 is an embodiment of "fixing portion", and is fixed via welding to the rotational axial protrusion 46 inside the through-hole 26. In this modified embodiment, the rotational axial protrusion 46 and the fixing pivot 59 integrally rotate relative to the through-hole 26.

In addition, the base member 17 can be provided with a hand-operated driving device (not shown) equipped with an operating handle as a drive source as a substitute for the motor 18, and a pinion gear of the hand-operated driving device which rotates by rotating the operating handle can be made to be associated with the driven gear 35 (the gear portion 36).

INDUSTRIAL APPLICABILITY

In the regulator device according to the present invention, the equalizer arm, which is configured of the first and the second arm, and the lift arm rotate smoothly relative to each other since the rotational contact surface of the first arm is rotatably in contact with a protrusion of the lift arm without being in contact with the flange wall of the lift arm and since the second arm is rotatably in contact with the lift arm. In addition, since the flange wall of the lift arm is projected at a different position from the protrusion, the entire lift arm that includes the protrusion is thinner than the conventional thickness. Accordingly, it is possible to reduce not only the thickness of the lift arm but also the thickness of the entire regulator device (in the widthwise direction of the door). Accordingly, the regulator device according to the present invention has an industrial applicability.

DESCRIPTION OF THE REFERENCE NUMERALS

15 Regulator device
17 Base member
18 Motor (drive source)
19 Pinion gear
20 Lift arm bracket
21 Slide groove
25 Lift arm
26 Through-hole
27 Pin support hole
28 Gear fixing hole
29 Elongated reinforcing protrusion (protrusion)(elongated protrusion)
30 Annular clearance
31 Flange wall
32 Peripheral portion
33 Rotational slide pin
35 Driven gear
36 Gear portion
38 Equalizer arm bracket
40 Equalizer arm
42 First arm
43 Elongated reinforcing protrusion
44 Pin support hole
45 Peripheral portion
46 Rotational axial protrusion
47 Rotational contact surface
50 Second arm
51 Elongated reinforcing protrusion
52 Pin support hole
53 Welding projection
55 Contact projection
56 Fixing surface (fixing portion)
58 Rotational slide pin
59 Fixing pivot (fixing portion)

The invention claimed is:

1. A regulator device for a vehicle door window pane, comprising:

a lift arm which is installed in an internal space of a vehicle door and connected at one end of said lift arm to said vehicle door window pane which is movable relative to said door, wherein the other end of said lift arm receives a rotational force from a drive source; and an equalizer arm which is installed in said internal space, rotatably connected to an intermediate portion of said lift arm, and wherein one end of said equalizer arm is connected to said door and the other end of said equalizer is connected to said door window pane, wherein said lift arm comprises:

a through-hole formed through said intermediate portion;

a flange wall having a ring shape which is formed at a circumferential edge of said through-hole to project in a protruding direction from one side of said lift arm; and a protrusion formed to define an annular clearance between said protrusion and said flange wall and to protrude in the same protruding direction as said protruding direction of said flange wall by a greater amount than said flange wall, wherein said equalizer arm comprises:

a first arm which is positioned on one side of said lift arm and includes a rotational contact surface which is rotatably in contact with said protrusion; and a second arm which is positioned on the other side of said lift arm and rotatably in contact with said other side of said lift arm, and wherein a rotational axial protrusion which is rotatably engaged in said through-hole, so as to pass through said through-hole, is formed on only one of said first arm and said second arm, and a fixing portion which is fixed to said rotational axial protrusion outside said through-hole and said flange wall, formed at said circumferential edge of said through-hole, is formed on the other of said first arm and said second arm.

2. The regulator device for a vehicle door window pane according to claim 1, wherein said rotational axial protrusion is formed on said first arm and said fixing portion is formed on said second arm.

3. The regulator device for a vehicle door window pane according to claim 2, wherein a contacting projection (55) is formed on said first arm and is rotatably in contact with a surface of said lift arm.

4. The regulator device for a vehicle door window pane according to claim 1, wherein said protrusion comprises part of an elongated protrusion which is elongated in a lengthwise direction of said lift arm.

5. The regulator device for a vehicle door window pane according to claim 1, wherein said fixing portion comprises a flat surface that lies in a plane in which one of said first arm and said second arm, where said fixing portion is formed, substantially lies.

6. The regulator device for a vehicle door window pane according to claim 1, wherein said fixing portion is fixed to said rotational axis protrusion at a position outside said through-hole and said flange wall with respect to a rotational axis direction of said rotational axial protrusion.

* * * * *